US008937437B2

(12) United States Patent
Kumar et al.

(10) Patent No.: US 8,937,437 B2
(45) Date of Patent: Jan. 20, 2015

(54) BALLAST WITH ANTI-STRIATION CIRCUIT

(71) Applicants: Nitin Kumar, Burlington, MA (US); Shashank Bakre, Burlington, MA (US)

(72) Inventors: Nitin Kumar, Burlington, MA (US); Shashank Bakre, Burlington, MA (US)

(73) Assignee: Osram Syvlania Inc., Danvers, MA (US)

( * ) Notice: Subject to any disclaimer, the term of this patent is extended or adjusted under 35 U.S.C. 154(b) by 0 days.

(21) Appl. No.: 13/917,414

(22) Filed: Jun. 13, 2013

(65) Prior Publication Data

US 2014/0368120 A1 Dec. 18, 2014

(51) Int. Cl.
*H05B 41/36* (2006.01)
*H05B 37/02* (2006.01)

(52) U.S. Cl.
CPC ..... *H05B 37/02* (2013.01)
USPC ..... 315/224; 315/291; 315/297; 315/209; 315/307

(58) Field of Classification Search
CPC .... H05B 33/0815; H05B 41/34; H05B 41/28; H05B 41/3925
USPC ..... 315/297, 200 R, 209, 224, 307
See application file for complete search history.

(56) References Cited

U.S. PATENT DOCUMENTS 5,426,349 A * 6/1995 Nilssen ..... 315/219
5,438,243 A * 8/1995 Kong ..... 315/219
5,694,006 A * 12/1997 Konopka ..... 315/219
5,856,919 A * 1/1999 Moriarty, Jr. ..... 363/101
6,057,611 A * 5/2000 Reiser ..... 307/125
6,194,845 B1 * 2/2001 Konopka et al. ..... 315/291
6,657,400 B2 * 12/2003 Konopka et al. ..... 315/224
7,560,874 B2 * 7/2009 Gahalaut ..... 315/224
8,779,674 B2 * 7/2014 Lam et al. ..... 315/200 R
8,810,146 B1 * 8/2014 Mays et al. ..... 315/247
2003/0107332 A1 * 6/2003 Newman et al. ..... 315/307
2004/0130273 A1 * 7/2004 Alexandrov ..... 315/291
2009/0160347 A1 6/2009 Xie et al.
2010/0102755 A1 * 4/2010 Liess et al. ..... 315/297
2012/0161655 A1 * 6/2012 Martin et al. ..... 315/200 R
2012/0314464 A1 * 12/2012 Weiss et al. ..... 363/56.01
2014/0265897 A1 * 9/2014 Taipale et al. ..... 315/200 R

* cited by examiner

*Primary Examiner* — Thuy Vinh Tran
*Assistant Examiner* — Syed M Kaiser
(74) *Attorney, Agent, or Firm* — Shaun P. Montana

(57) ABSTRACT

A ballast comprises an inverter circuit for providing an oscillating current signal for energizing the at least one lamp. The inverter circuit comprises a first switching component and a second switching component each having a collector terminal, a base terminal, and an emitter terminal. And, each switching component is configured for alternately operating between a conductive state and a non-conductive state. A first collector-emitter circuit is connected between the collector terminal and the emitter terminal of the first switching component, wherein the first collector-emitter circuit has a first resistance of zero or more Ohms. A second collector-emitter circuit is connected between the collector terminal and the emitter terminal of the second switching component, wherein the second collector-emitter circuit has a second resistance of zero or more Ohms and the first resistance and the second resistance are unequal.

13 Claims, 5 Drawing Sheets

BALLAST WITH ANTI-STRIATION CIRCUIT

TECHNICAL FIELD

The present invention relates to lighting, and more specifically, to electronic ballasts for lighting.

BACKGROUND

A ballast converts alternating current (AC) power from an AC power supply so that it is suitable for energizing a lamp connected to the ballast. A ballast may include a rectifier for generating a direct current (DC) signal from the AC power received from the AC power supply, a power factor correction circuit for correcting the DC signal generated by the rectifier, and an inverter for converting the corrected DC signal to an oscillating voltage for providing to the lamp.

A ballast is used to provide power for energizing various types of lamps including gas discharge lamps. A gas discharge lamp, such as a fluorescent lamp, converts power received from the ballast into visible energy (i.e., light). While gas discharge lamps are commonly used in various lighting applications, they often produce a visual effect known in the art as "striations." Striations refer to alternating bands of bright and dim areas that form along an axis of a tube of a gas discharge lamp. They may take the appearance of a standing wave.

SUMMARY

Embodiments of the present invention relate to a ballast designed to minimize striations from being produced by a lamp when the lamp is powered by the ballast. The ballast is configured for connecting to an alternating current (AC) power supply, and includes a rectifier for receiving an AC voltage signal via the power supply and producing a rectified voltage signal therefrom. A power factor correction circuit receives the rectified voltage signal and provides a corrected voltage signal. An inverter circuit receives the corrected voltage signal and generates an oscillating power signal for energizing the lamp as a function of the corrected voltage signal. The power signal has a waveform in which consecutive cycles are asymmetrical with respect one another.

The inverter circuit includes a first transistor and a second transistor, each configured to alternately operate between a conductive state and a non-conductive state. When the first transistor operates in the conductive state, the second transistor operates in the non-conductive state and vice a versa. The first transistor and the second transistor each have a collector terminal, a base terminal, and an emitter terminal. A first collector-emitter circuit is connected between the collector terminal and the emitter terminal of the first transistor. A second collector-emitter circuit is connected between the collector terminal the emitter terminal of the second transistor. In one embodiment, resistance generated by the first collector-emitter circuit and resistance generated by the second collector-emitter circuit are unequal. Since the resistances are unequal, the consecutive cycles of the power signal waveform produced by the inverter circuit are asymmetrical with respect to one another. The power signal is provided to the lamps to effectively minimize striations.

In an embodiment, there is provided a ballast. The ballast includes: an inverter circuit to provide an oscillating current signal to energize at least one lamp, wherein the inverter circuit includes: a first switching component having a collector terminal, a base terminal, and an emitter terminal, wherein the first switching component is configured to alternately operate between a conductive state and a non-conductive state; a first collector-emitter circuit connected between the collector terminal and the emitter terminal of the first switching component, wherein the first collector-emitter circuit has a first resistance of zero or more Ohms; a second switching component having a collector terminal, a base terminal, and an emitter terminal, wherein the second switching component is configured to alternately operate between a conductive state and a non-conductive state; and a second collector-emitter circuit connected between the collector terminal and the emitter terminal of the second switching component, wherein the second collector-emitter circuit has a second resistance of zero or more Ohms; wherein the first resistance and the second resistance are unequal.

In a related embodiment, the first collector-emitter circuit may include a diode and a resistive component connected together in series. In a further related embodiment, the resistive component may include one or more resistors. In another further related embodiment, the second collector-emitter circuit may include a diode.

In another related embodiment, the first collector-emitter circuit may include a first diode and a first resistive component connected together in series, and wherein the second collector-emitter circuit may include a second diode and a second resistive component connected together in series, wherein the resistance of the first resistive component may be greater than the resistance of the second resistive component.

In yet another related embodiment, the ballast may further include: a rectifier to receive an alternating current (AC) voltage signal and to produce a rectified voltage signal therefrom; and a power factor correction circuit electrically connected to the rectifier to receive the rectified voltage signal and to provide a corrected voltage signal, wherein the inverter circuit may be electrically connected to the power factor correction circuit to receive the corrected voltage signal and to generate the oscillating current signal therefrom.

In another embodiment, there is provided a ballast. The ballast includes: an inverter circuit to provide an oscillating current signal to energize at least one lamp, wherein the inverter circuit includes: a first switching component having a collector terminal, a base terminal, and an emitter terminal, wherein the first switching component is configured to alternately operate between a conductive state and a non-conductive state; a first diode connected between the collector terminal and the emitter terminal of the first switching component; a second switching component having a collector terminal, a base terminal, and an emitter terminal, wherein the second switching component is configured to alternately operate between a conductive state and a non-conductive state, wherein the collector terminal of the second switching component is connected to the emitter terminal of the first switching component; a second diode connected between the collector terminal and the emitter terminal of the second diode; and a resistive component connected in series with the first diode between the collector terminal and the emitter terminal of the first switching component so a greater resistance is generated across the collector terminal and the emitter terminal of the first switching component than is generated across the collector terminal and the emitter terminal of the second switching component.

In a related embodiment, the resistive component may include a resistor. In another related embodiment, the resistive component may include a plurality of resistors connected together. In still another related embodiment, the ballast may further include: a rectifier to receive an alternating current (AC) voltage signal and to produce a rectified voltage signal therefrom; and a power factor correction circuit electrically connected to the rectifier to receive the rectified voltage signal and to provide a corrected voltage signal, wherein the inverter circuit is electrically connected to the power factor correction circuit top receive the corrected voltage signal and to generating the oscillating current signal therefrom.

In another embodiment, there is provided a ballast. The ballast includes: an inverter circuit for providing an oscillating current signal to energize at least one lamp, wherein the inverter circuit includes: a first switching component having a collector terminal, a base terminal, and an emitter terminal, wherein the first switching component is configured to alternately operate between a conductive state and a non-conductive state; a first diode connected between the collector terminal and the emitter terminal of the first switching component; a second switching component having a collector terminal, a base terminal, and an emitter terminal, wherein the second switching component is configured to alternately operate between a conductive state and a non-conductive state, wherein the collector terminal of the second switching component is connected to the emitter terminal of the first switching component; a second diode connected between the collector terminal and the emitter terminal of the second diode; and a resistive component connected in series with the second diode between the collector terminal and the emitter terminal of the second switching component so a greater resistance is generated across the collector terminal and the emitter terminal of the second switching component than is generated across the collector terminal and the emitter terminal of the first switching component.

In a related embodiment, the resistive component may include a resistor. In another related embodiment, the resistive component may include a plurality of resistors connected together. In yet another related embodiment, the ballast may further include: a rectifier to receive an alternating current (AC) voltage signal and to produce a rectified voltage signal therefrom; and a power factor correction circuit electrically connected to the rectifier to receive the rectified voltage signal and to provide a corrected voltage signal, wherein the inverter circuit may be electrically connected to the power factor correction circuit to receive the corrected voltage signal and to generate the oscillating current signal therefrom.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
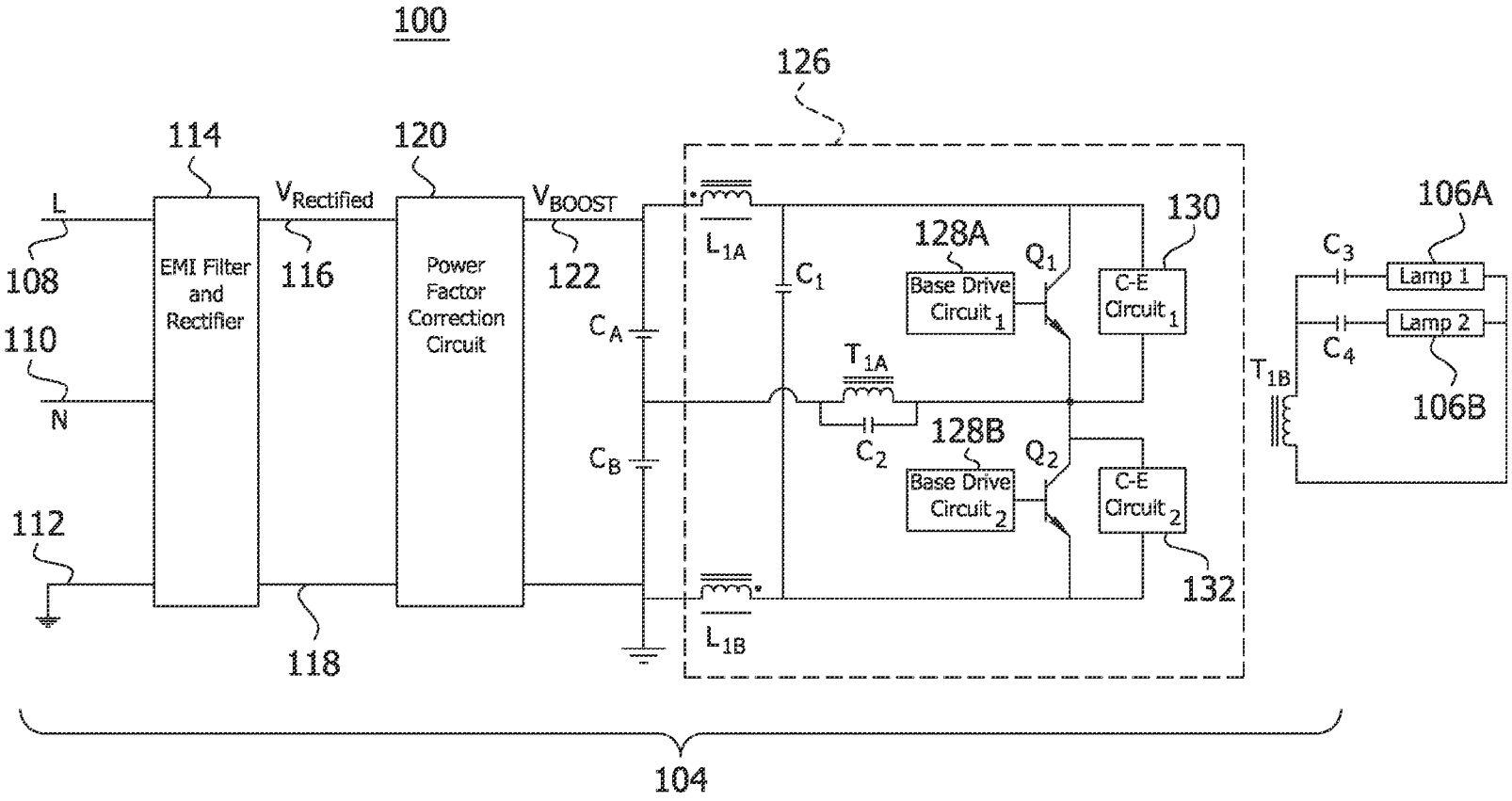
FIG. 1 is a schematic diagram, partially in block form, of a lamp system according to embodiments disclosed herein.

FIG. 1 illustrates a lamp system 100 that includes an input power source (not shown), such as but not limited to an alternating current (AC) power supply, an electronic ballast 104 (hereinafter ballast 104), and a lamp set 106A, 106B. In some embodiments, the lamp set 106A, 106B includes low pressure discharge lamps, such as but not limited to T8 fluorescent lamps available from OSRAM SYLVANIA, Philips, or General Electric. However, the scope of the application contemplates the use of other types of lamps as well. Additionally, although the lamp system 100 illustrates a lamp set including two lamps 106A, 106B connected together in parallel, the scope of the invention contemplates the use of one or more lamps which may be connected together in series or in parallel.

The ballast 104 includes at least one high voltage input terminal (i.e., line voltage input terminal) 108 adapted for connecting to the alternating current (AC) power supply (e.g., standard 120V AC household power), a neutral input terminal 110, and a ground terminal 112 connectable to ground potential. An input AC power signal is received by the ballast 104 from the AC power supply via the high voltage input terminal 108. The ballast 104 includes an electromagnetic interference (EMI) filter and a rectifier (e.g., full-wave rectifier) 114, which are illustrated together in FIG. 1. The EMI filter portion of the EMI filter and rectifier 114 prevents noise that may be generated by the ballast 104 from being transmitted back to the AC power supply. The rectifier portion of the EMI filter and rectifier 114 converts AC voltage received from the AC power supply to direct current (DC) voltage. The rectifier portion includes a first output terminal connected to a DC bus 116 and a second output terminal connected to a ground potential at ground connection point 118. Thus, the EMI filter and rectifier 114 outputs a DC voltage ($V_{Rectified}$) on the DC bus 116.

A power factor correction circuit 120, which may be, and in some embodiments is, a boost converter, is connected to the first and second output terminals of the EMI filter and rectifier 114. The power factor correction circuit 120 receives the rectified DC voltage ($V_{Rectified}$) and produces a high DC voltage ($V_{Boost}$) on a high DC voltage bus ("high DC bus") 122. Energy storage electrolytic capacitors CA and CB are connected across the output of the power factor correction circuit 120 to provide a low impedance voltage. An inverter circuit 126, such as a current fed half bridge inverter, has an input connected to the power factor correction circuit 120 for receiving the low impedance, high DC voltage. The inverter circuit 126 is configured to convert this voltage to an oscillating power signal for supplying to the lamps 106A, 106B. In some embodiments, the inverter circuit 126 includes switching circuitry described below, a current choke transformer having a primary winding $L_{1A}$ and a secondary winding $L_{1B}$, and an output transformer T1 having a primary winding $T_{1A}$ and a secondary winding $T_{1B}$ for providing the power signal to the lamps 106A, 106B.

In FIG. 1, the inverter circuit 126 includes a first switching component Q1 and a second switching component Q2. In some embodiments, for example, the first switching component Q1 and the second switching component Q2 each comprise a transistor such as but not limited to a bipolar junction transistor (BJT) (e.g., NPN BJT). As such, the first switching component Q1 and the second switching component Q2 each have a collector terminal, a base terminal, and an emitter terminal. A first base drive circuit 128A is connected to the base terminal of the first switching component Q1 for driving the first switching component Q1. A second base drive circuit 128B is connected to the base terminal of the second switching component Q2 for driving the second switching component Q2. The first switching component Q1 and the second switching component Q2 complementarily operate between a non-conductive state and a conductive state in order to produce the oscillating power signal. In other words, when the first switching component Q1 operates in the conductive state, the second switching component Q2 operates in the non-conductive state. And, when the second switching component Q2 operates in the conductive state, the first switching component Q1 operates in the non-conductive state.

A first collector-emitter circuit 130 is connected between the collector terminal and the emitter terminal of the first switching component Q1, and a second collector-emitter circuit 132 is connected between the collector terminal and the emitter terminal of the second switching component Q2. The first collector-emitter circuit 130 has a first resistance of zero or more Ohms, and the second collector-emitter circuit 132 has a second resistance of zero or more Ohms. However, the first resistance and the second resistance are unequal, causing the portion of the power signal waveform produced when the first switching component Q1 is conductive to be different from the portion of the power signal waveform that is produced when the second switching component Q2 is conductive. As such, the consecutive cycles of the power signal (e.g., voltage, current) waveform generated by the inverter circuit 126 are asymmetrical, which substantially prevents lamp striations.

Figure 2:
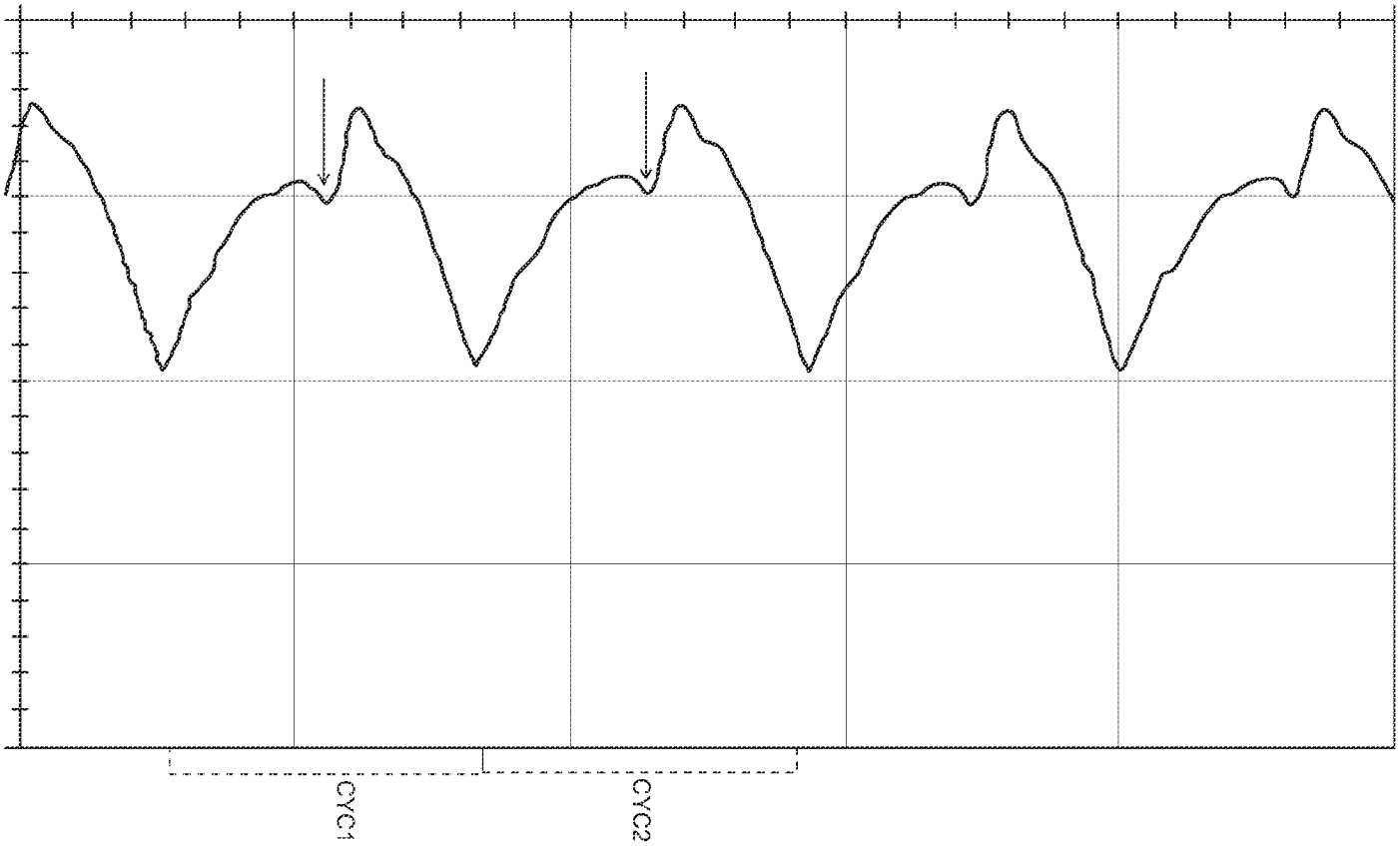
FIG. 2 is a waveform of a lamp current signal generated by a ballast according to embodiments disclosed herein.
Figure 3:
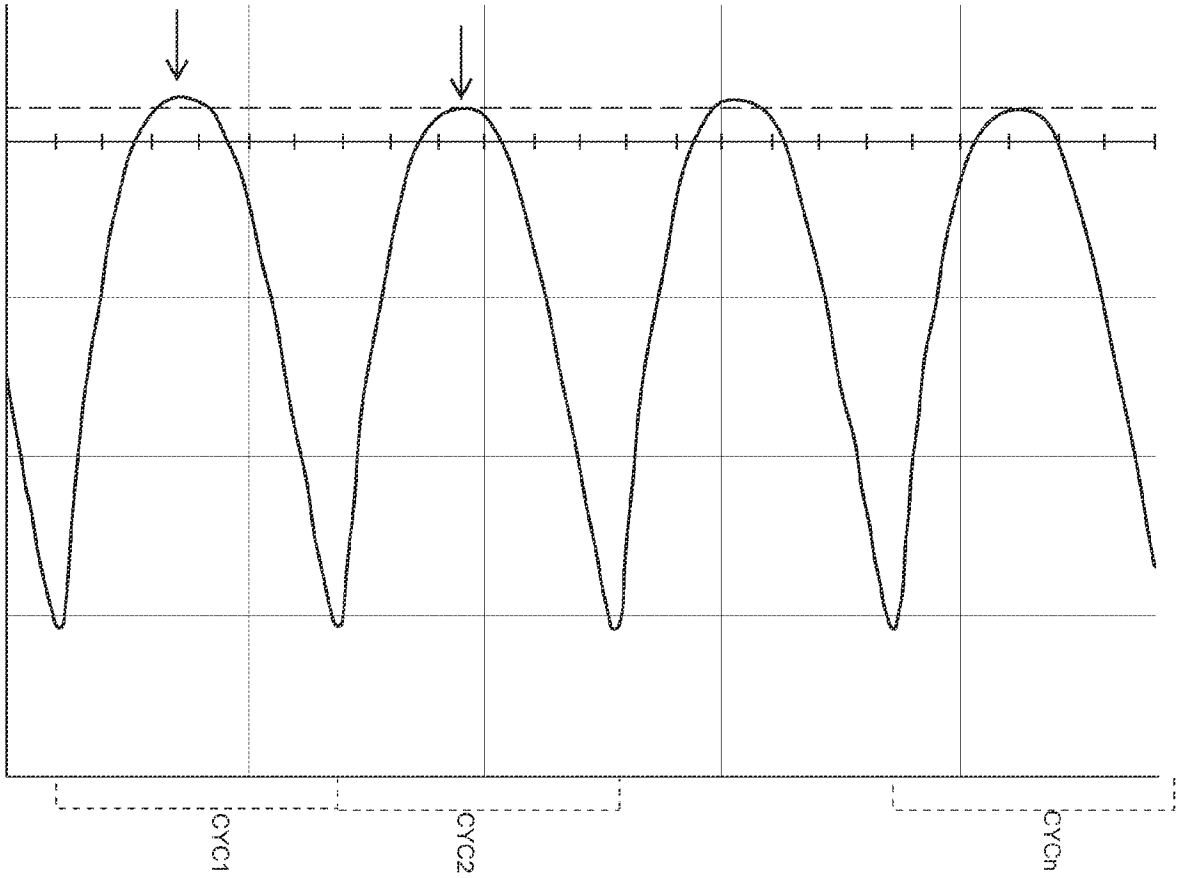
FIG. 3 is a waveform of a lamp voltage signal generated by a ballast according to embodiments disclosed herein.

FIG. 2 is a current waveform produced, as illustrated and emphasized with arrows, where consecutive cycles (e.g., CYC1 and CYC2) of the current waveform are asymmetrical. FIG. 3 is a voltage waveform produced, as illustrated and emphasized with arrows, where consecutive cycles (e.g., CYC1 and CYC2) of the voltage waveform are asymmetrical.

Figure 4:
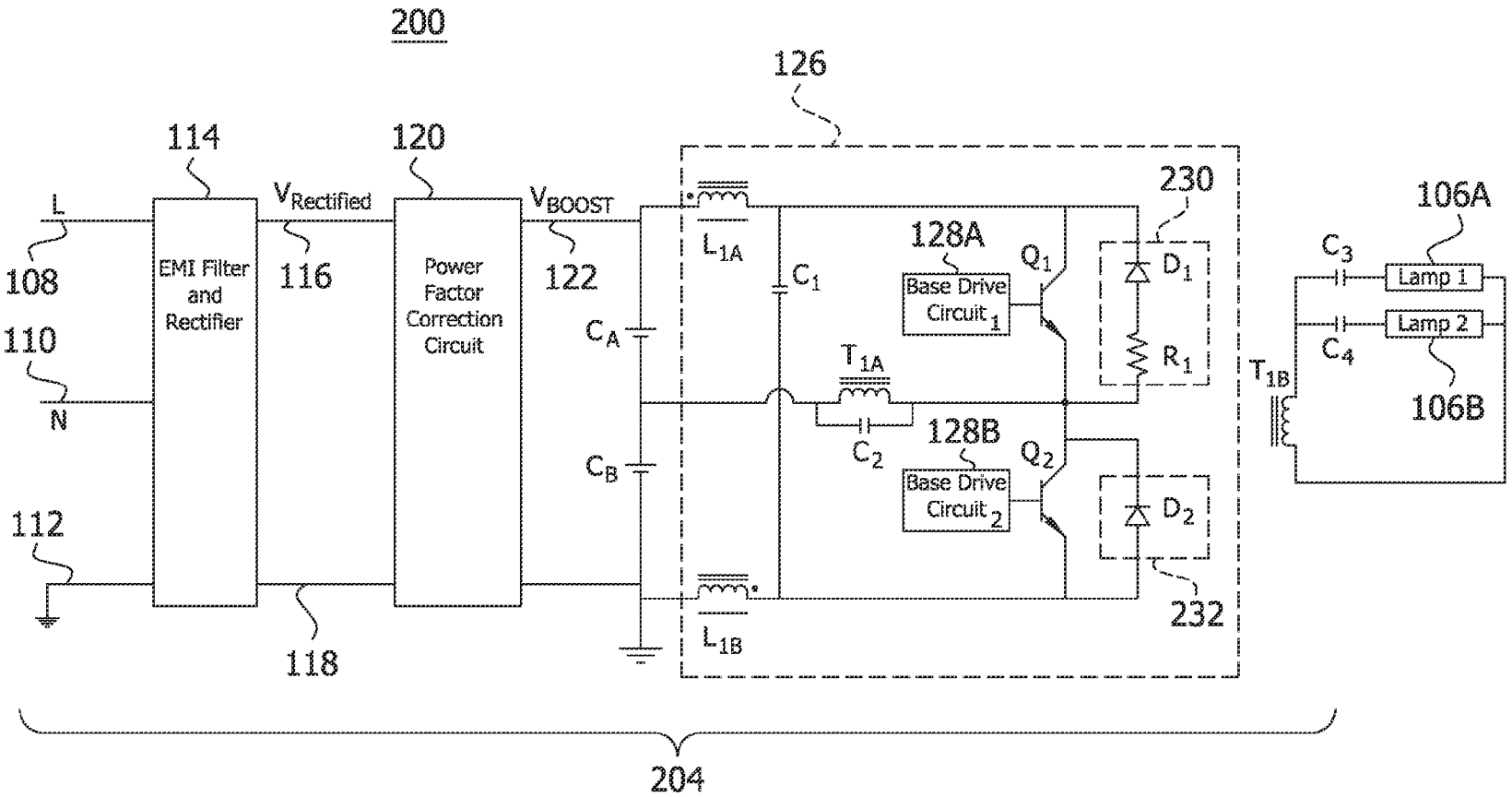
FIGS. 4 and 5 are each a schematic diagram, partially in block form, of a lamp system according to embodiments disclosed herein.

FIG. 4 shows a lamp system 200, similar to the lamp system 100 of FIG. 1, where a first collector-emitter circuit 230 comprises a first diode D1 connected across collector and emitter terminals of a first switching component Q1, and a second collector-emitter circuit 232 comprises a second diode D2 connected across collector and emitter terminals of a second switching component Q2. The first diode D1 and the second diode D2 eliminate current spikes from the first switching component Q1 and the second switching component Q2, respectively. A resistor R1 is connected in series with the first diode D1 between the collector and emitter terminals of the first collector-emitter circuit 230. In FIG. 4, of the collector-emitter circuits 230 and 232, only the first collector-emitter circuit 230 includes a resistor R1 (broadly, a resistive component). Thus, the resistance generated across the collector terminal and the emitter terminal of the first switching component Q1 is greater than the resistance (which may be substantially zero) that is generated across the collector terminal and the emitter terminal of the second switching component Q2. Thus, consecutive cycles of the power signal (e.g., voltage, current) waveform generated by the inverter circuit 126 are asymmetrical effectively minimizing lamp striations.

Figure 5:
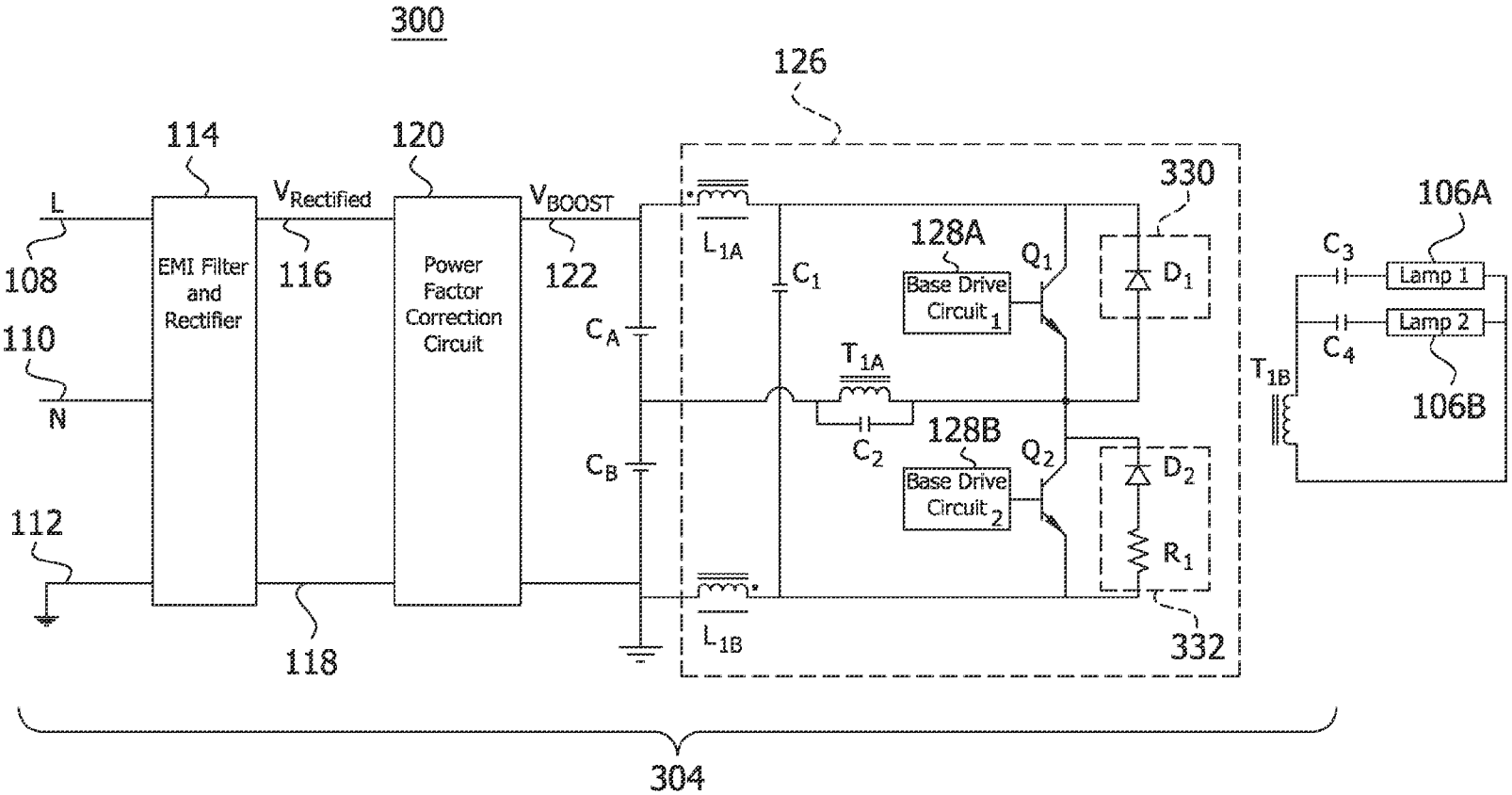

FIG. 5 illustrates a lamp system 300 that is similar to the lamp system 100 of FIG. 1 and the lamp system 200 of FIG. 4. A first collector-emitter circuit 330 comprises a first diode D1 connected across collector and emitter terminals of a first switching component Q1, and a second collector-emitter circuit 332 comprises a second diode D2 connected across collector and emitter terminals of a second switching component Q2. The first diode D1 and the second diode D2 eliminate current spikes from the first switching component Q1 and the second switching component Q2, respectively. A resistor R1 is connected in series with the second diode D2 between the collector and emitter terminals of the second collector-emitter circuit 332. In FIG. 5, of the collector-emitter circuits 330 and 332, only the second collector-emitter circuit 332 includes a resistor R1 (broadly, a resistive component). Thus, the resistance generated across the collector terminal and the emitter terminal of the second switching component Q2 is greater than the resistance (which may be substantially zero) that is generated across the collector terminal and the emitter terminal of the second switching component Q1. Thus, consecutive cycles of the power signal (e.g., voltage, current) waveform generated by the inverter circuit 326 are asymmetrical effectively minimizing lamp striations.

Although not specifically illustrated, the present invention contemplates embodiments in which the first collector-emitter circuit 130 and the second collector-emitter circuit 132 both include one or more resistors that, together, are connected in series to the respective diodes D1 and D2, wherein the effective resistance generated by the one or more resistors that are series-connected to the first diode D1 is not equal (i.e., unequal) to the effective resistance generated by the one or more resistors that are series-connected to the second diode D2.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A ballast comprising:

an inverter circuit to provide an oscillating current signal to energize at least one lamp, wherein the inverter circuit comprises:

a first switching component having a collector terminal, a base terminal, and an emitter terminal, wherein the first switching component is configured to alternately operate between a conductive state and a non-conductive state;

a first collector-emitter circuit connected between the collector terminal and the emitter terminal of the first switching component, wherein the first collector-emitter circuit has a first resistance of zero or more Ohms;

a second switching component having a collector terminal, a base terminal, and an emitter terminal, wherein the second switching component is configured to alternately operate between a conductive state and a non-conductive state; and a second collector-emitter circuit connected between the collector terminal and the emitter terminal of the second switching component, wherein the second collector-emitter circuit has a second resistance of zero or more Ohms;

wherein the first resistance and the second resistance are unequal, and wherein the first collector-emitter circuit comprises a first diode and a first resistive component connected together in series, and wherein the second collector-emitter circuit comprises a second diode and a second resistive component connected together in series, wherein the resistance of the first resistive component is greater than the resistance of the second resistive component.

2. The ballast of claim 1, wherein the first collector-emitter circuit comprises a diode and a resistive component connected together in series.

3. The ballast of claim 2, wherein the resistive component comprises one or more resistors.

4. The ballast of claim 2, wherein the second collector-emitter circuit comprises a diode.

5. The ballast of claim 1, further comprising:

a rectifier to receive an alternating current (AC) voltage signal and to produce a rectified voltage signal therefrom; and a power factor correction circuit electrically connected to the rectifier to receive the rectified voltage signal and to provide a corrected voltage signal, wherein the inverter circuit is electrically connected to the power factor correction circuit to receive the corrected voltage signal and to generate the oscillating current signal therefrom.

6. A ballast comprising:

an inverter circuit to provide an oscillating current signal to energize at least one lamp, wherein the inverter circuit comprises:

a first switching component having a collector terminal, a base terminal, and an emitter terminal, wherein the first switching component is configured to alternately operate between a conductive state and a non-conductive state;

a first diode connected between the collector terminal and the emitter terminal of the first switching component;

a second switching component having a collector terminal, a base terminal, and an emitter terminal, wherein the second switching component is configured to alternately operate between a conductive state and a non-conductive state, wherein the collector terminal of the second switching component is connected to the emitter terminal of the first switching component;

a second diode connected between the collector terminal and the emitter terminal of the second switching component; and a resistive component connected in series with the first diode between the collector terminal and the emitter terminal of the first switching component so a greater resistance is generated across the collector terminal and the emitter terminal of the first switching component than is generated across the collector terminal and the emitter terminal of the second switching component.

7. The ballast of claim 6, wherein the resistive component comprises a resistor.

8. The ballast of claim 6, wherein the resistive component comprises a plurality of resistors connected together.

9. The ballast of claim 6, further comprising:

a rectifier to receive an alternating current (AC) voltage signal and to produce a rectified voltage signal therefrom; and a power factor correction circuit electrically connected to the rectifier to receive the rectified voltage signal and to provide a corrected voltage signal, wherein the inverter circuit is electrically connected to the power factor correction circuit top receive the corrected voltage signal and to generating the oscillating current signal therefrom.

10. A ballast comprising:

an inverter circuit for providing an oscillating current signal to energize at least one lamp, wherein the inverter circuit comprises:

a first switching component having a collector terminal, a base terminal, and an emitter terminal, wherein the first switching component is configured to alternately operate between a conductive state and a non-conductive state;

a first diode connected between the collector terminal and the emitter terminal of the first switching component;

a second switching component having a collector terminal, a base terminal, and an emitter terminal, wherein the second switching component is configured to alternately operate between a conductive state and a non-conductive state, wherein the collector terminal of the second switching component is connected to the emitter terminal of the first switching component;

a second diode connected between the collector terminal and the emitter terminal of the second switching component; and a resistive component connected in series with the second diode between the collector terminal and the emitter terminal of the second switching component so a greater resistance is generated across the collector terminal and the emitter terminal of the second switching component than is generated across the collector terminal and the emitter terminal of the first switching component.

11. The ballast of claim 10, wherein the resistive component comprises a resistor.

12. The ballast of claim 10, wherein the resistive component comprises a plurality of resistors connected together.

13. The ballast of claim 11, further comprising:

a rectifier to receive an alternating current (AC) voltage signal and to produce a rectified voltage signal therefrom; and a power factor correction circuit electrically connected to the rectifier to receive the rectified voltage signal and to provide a corrected voltage signal, wherein the inverter circuit is electrically connected to the power factor correction circuit to receive the corrected voltage signal and to generate the oscillating current signal therefrom.

* * * * *